US010683735B1

(12) United States Patent
McCarthy et al.

(10) Patent No.: US 10,683,735 B1
(45) Date of Patent: Jun. 16, 2020

(54) PARTICULATE-FILLED ADAPTIVE CAPSULE (PAC) CHARGE

(71) Applicant: The United States of America As Represented by the Secretary of the Navy, Indian Head, MD (US)

(72) Inventors: Daniel McCarthy, LaPlata, MD (US); Lee Foltz, Indian Head, MD (US); Angel Diaz, Indian Head, MD (US); David Rivera Marchand, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/501,559

(22) Filed: May 1, 2019

(51) Int. Cl.
*F42B 1/028* (2006.01)
*E21B 43/117* (2006.01)
*F42B 1/032* (2006.01)

(52) U.S. Cl.
CPC ..... *E21B 43/117* (2013.01); *F42B 1/028* (2013.01); *F42B 1/032* (2013.01)

(58) Field of Classification Search
CPC .. F42B 1/02; F42B 1/024; F42B 1/028; F42B 1/032; F42B 3/22; F42B 12/10; F42B 12/32
See application file for complete search history.

(56) References Cited

U.S. PATENT DOCUMENTS 189,358 A * 4/1877 Hotchkiss ..... F42B 12/32 102/494
2,900,905 A * 8/1959 MacDougall ..... F42B 1/024 102/306
2,972,949 A * 2/1961 MacLeod ..... F42B 23/10 102/401
3,224,368 A * 12/1965 House ..... F42B 1/028 102/306
3,437,036 A * 4/1969 Franzen ..... F42B 1/036 102/401
3,443,518 A * 5/1969 Cross ..... F42B 1/02 102/306
3,732,816 A * 5/1973 Muller ..... F42B 1/028 102/306
3,974,771 A * 8/1976 Thomanek ..... F42B 12/14 102/494
4,499,830 A * 2/1985 Majerus ..... F42B 1/032 102/307
4,766,813 A * 8/1988 Winter ..... F42B 1/032 102/307
4,982,665 A * 1/1991 Sewell ..... F42B 1/02 102/306
5,090,324 A * 2/1992 Bocker ..... F42B 1/032 102/307
5,237,929 A * 8/1993 Ekholm ..... F42B 1/02 102/476

(Continued)

*Primary Examiner* — Derrick R Morgan
(74) *Attorney, Agent, or Firm* — Fredric J. Zimmerman

(57) ABSTRACT

A shaped charge includes a casing with a liner disposed therein. The liner has two spaced-apart and nested walls with each wall having an identical ogive shape. An explosive material fills a portion of the casing up to one of the walls. A loose particulate material is disposed between the walls. A blasting cap is coupled to a first axial end of the casing adjacent to the explosive material, and a sealing cap is coupled to a second axial end of the casing.

18 Claims, 3 Drawing Sheets

(56) References Cited

U.S. PATENT DOCUMENTS 5,251,561 A * 10/1993 Murphy ..... F42B 1/024 102/307
5,279,228 A * 1/1994 Ayer ..... F42B 1/032 102/306
5,351,622 A * 10/1994 Ekholm ..... F42B 1/036 102/476
H001504 H * 12/1995 Crabtree ..... 102/476
5,522,319 A * 6/1996 Haselman, Jr. ..... F42B 1/028 102/306
5,792,980 A * 8/1998 Weimann ..... F42B 1/024 102/438
6,021,714 A * 2/2000 Grove ..... E21B 43/117 102/307
6,179,944 B1 * 1/2001 Monolo ..... B29C 53/585 102/473
6,186,070 B1 * 2/2001 Fong ..... F42B 1/028 102/476
6,510,797 B1 * 1/2003 Fong ..... F42B 1/028 102/307
6,786,157 B1 * 9/2004 Powell ..... F42B 1/032 102/306
6,983,698 B1 * 1/2006 Walters ..... F42B 1/02 102/305
7,011,027 B2 3/2006 Reese et al.
7,819,064 B2 * 10/2010 Saenger ..... E21B 37/08 102/306
8,220,394 B2 7/2012 Bates et al.
8,240,251 B2 8/2012 Waddell et al.
8,794,153 B2 8/2014 Glenn
8,985,024 B2 3/2015 Yang et al.
9,291,435 B2 * 3/2016 Scheid ..... F42B 1/02
9,482,499 B1 * 11/2016 Gotzmer ..... F42B 1/032
2003/0037692 A1 * 2/2003 Liu ..... F42B 1/032 102/301
2007/0107616 A1 * 5/2007 Grove ..... F42B 1/032 102/306
2008/0282924 A1 * 11/2008 Saenger ..... F42B 1/032 102/306
2009/0235836 A1 * 9/2009 Pratt ..... F42B 1/028 102/306
2011/0155013 A1 * 6/2011 Boyer ..... E21B 43/117 102/307
2012/0247358 A1 * 10/2012 Daoud ..... F42B 1/032 102/307
2013/0104765 A1 * 5/2013 Stecher ..... F42B 12/10 102/476
2014/0291022 A1 * 10/2014 Yang ..... F42B 1/028 175/2
2015/0292306 A1 * 10/2015 Collins ..... F42B 1/02 166/55.1
2017/0010077 A1 * 1/2017 Medina ..... F42B 1/032

* cited by examiner

PARTICULATE-FILLED ADAPTIVE CAPSULE (PAC) CHARGE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to shaped charges and more particularly to a shaped charge having an ogive-shaped liner to provide penetration holes of constant diameter.

BACKGROUND OF THE INVENTION

Shaped charges are typically used to maximize penetration depth into and/or through armor or a structure. Traditional shaped charges incorporate a shaped, compressed liner within a casing that houses an explosive material. In general, penetration depth increases with increased liner density, while a penetration hole's diameter decreases with penetration depth. While designers of such shaped charges are usually unconcerned with diameter changes of the hole created by the penetration, some applications for shaped charges may benefit from the creation of a constant-diameter penetration hole. In addition, a compressed liner needs to be made in a factory and assembled into the complete shaped-charge weapon system prior to deployment. Accordingly, such shaped changes cannot be adapted in the field for changing application requirements.

SUMMARY OF THE INVENTION

Accordingly, it is an object of the present invention to provide a shaped charge that creates a constant-diameter penetration hole.

Another object of the present invention is to provide a shaped charge that may be assembled in the field for adaptation to a particular application.

Other objects and advantages of the present invention will become more obvious hereinafter in the specification and drawings.

In accordance with the present invention, a shaped charge includes a casing and a liner disposed in the casing. The liner has two spaced-apart and nested walls with each wall having an identical ogive shape. An explosive material fills a portion of the casing up to one of the walls. A loose particulate material is disposed between the walls. A blasting cap is coupled to a first axial end of the casing adjacent to the explosive material. A sealing cap is coupled to a second axial end of the casing.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
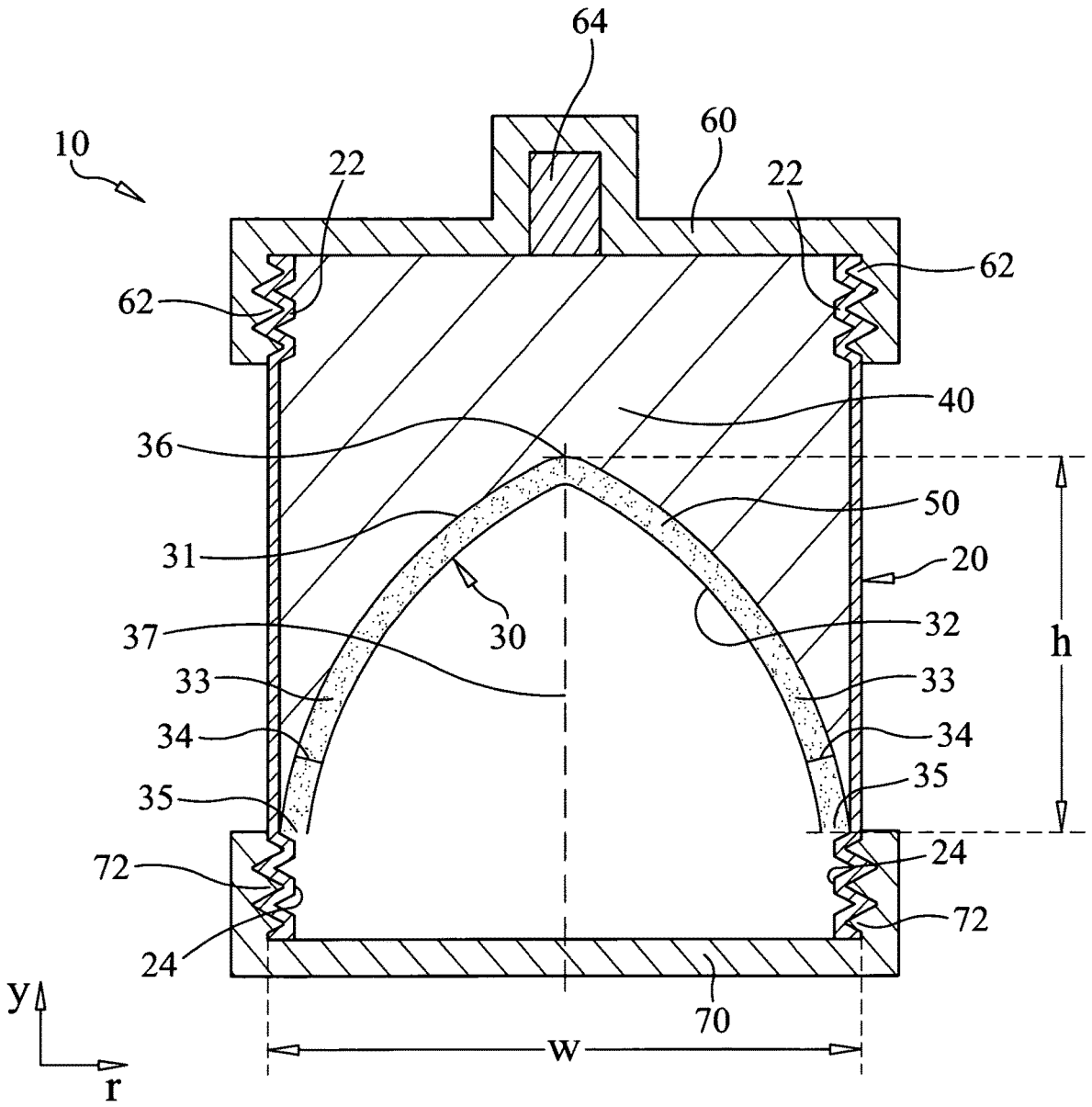
FIG. 1 is a schematic cross-sectional view of a shaped charge in accordance with an exemplary embodiment of the present invention.

Referring now to the drawings and more particularly to FIG. 1, a shaped charge capable of creating a constant-diameter penetration hole is shown and is referenced generally by numeral 10. By way of an exemplary embodiment, the design of shaped charge 10 lends itself to assembly and adaptation in a field setting thereby allowing a user to customize the shaped charge to satisfy the requirements of a particular application. However, it is to be understood that the novel features of the present invention could be incorporated into other fabrication designs such as those assembled in a factory prior to deployment in the field.

Shaped charge 10 includes a casing 20, a hollow and shaped liner 30, an explosive material 40 disposed in a portion of casing 20, a loose particulate material 50 disposed within liner 30, a blasting cap 60 coupled to one axial end of casing 20, and a sealing cap 70 coupled to the other axial end of casing 20. Descriptions of the various elements of shaped charge 10 provided herein will focus on the novel features of the present invention, while generally omitting design and fabrication details that are well-understood in the art. By way of example, the structural aspects of casing 20, liner 30, blasting cap 60, and sealing cap 70 can be fabricated using three-dimensional ("3D") printing techniques.

In the illustrated, exemplary embodiment, casing 20 is a generally cylindrical casing having threaded axial ends. More specifically, axial ends 22 and 24 of casing 20 are externally threaded. As will be described later herein, casing 20 also may be tapered and/or contoured between axial ends 24 and 22 without departing from the scope of present invention.

Disposed within and integrated with casing 20 is the hollow and shaped liner 30. More specifically, liner 30 includes spaced-apart liner walls 31 and 32 to thereby define an annular volume 33 there between. Each of liner walls 31 and 32 has an identical ogive (generally, a round tapered end of a three dimensional object) shape. Liner wall 31 is integrated with casing 20, and liner wall 32 is coupled to liner wall 31 with a plurality of spaced-apart ribs 34, the number and shape of which are not limitations of the present invention. Ribs 34 retain the nested relationship between liner walls 31 and 32. Liner 30 has an open annular base 35 and extends within casing 20 to an apex 36 of liner wall 31. By virtue of this construction, loose particulate material 50 is deposited into liner 30 via its open annular base 35 with such material 50 readily flowing past ribs 34 to fill annular volume 33 defined by liner 30.

As mentioned above, liner walls 31 and 32 trace an identical ogive shape that follows a parabolic contour given by $$y=a(r+c)^2+b \tag{1}$$

$$y(0)=h \tag{1a}$$

$$y(w)=0 \tag{1b}$$

where "y" is the height dimension of liner 30 for a radius in the radial dimension "r" of liner 30 measured from the centerline 37 of liner 30. That is and as noted in equations (1a) and (1b), the height of liner 30 is "h" at a radius of 0, and the height of liner 30 is 0 at the liner's largest width "w". The values for a, b, and c are functions of the liner height h and the liner width w. In order to avoid additional support material for liner 30, the slope of the parabolic function defining liner 30 is never allowed to exceed 45°, that is, at maximum or at most equal to 45°, i.e. the derivative of equation (1) with respect to x given by $$\frac{dy}{dx} = 2a(x+c) \tag{2}$$

evaluated at x equal to 0 must be $$\frac{dy}{dx}(0) = -1 \tag{2a}$$

Using (1a), (1b), (2a), the three unknowns in equation (1) can be found to be $$a = \frac{w-h}{w^2} \tag{3}$$

$$b = h - \frac{w^2}{4(w-h)} \tag{4}$$

$$c = -\frac{w^2}{2(w-h)} \tag{5}$$

Explosive material 40 fills the portion of casing 20 between liner wall 31 and blasting cap 60 such that blasting cap 60 is immediately adjacent to explosive material 40 as would be understood in the art. Explosive material 40 can be deposited into casing 20 in a factory or field setting without departing from the scope of the present invention. Suitable choices for explosive material 40 include field pack explosives such as C-4 as well as any energetic fill material such as TNT, PBXN, AFX, and other explosive materials, depending on the type of performance required for the particular application.

Loose particulate material 50 may be a variety of materials without departing from the scope of the present invention. For example, loose particulate material 50 may be an inert material whose grain size can be selected to produce different types of flow. Suitable inert metal particulates, include steel shot, lead shot, copper shot, and other materials, whose grain size may be selected to produce different types of flow. Non-metal powders such as ceramic, cement, clay, and other materials, also could be used to produce other types of flow. For impact into soft materials (e.g., soil, fabrics, etc.), higher density materials may be used for loose particulate material 50 to produce greater impact pressures corresponding to greater penetration. Still further, loose particulate material 50 may be sourced from readily-available particulates such as sand or salt. By being able to use readily-available inert materials for loose particulate material 50, the present invention is ideally suited for assembly in the field.

Blasting cap 60 is structurally configured to be coupled to threaded axial end 22 of casing 20. Accordingly, blasting cap 60 includes an internally threaded region 62 for engagements with threaded axial end 22. Blasting cap 60 also includes a blast initiator 64, the design of which is well understood in the art.

Sealing cap 70 is structurally configured to be coupled to threaded axial end 24 of casing 20. Accordingly, sealing cap 70 includes an internally threaded region 72 for engagement with threaded axial end 24. Sealing cap 70 closes/seals casing 20 and open annular base 35 of liner 30.

Figure 2:
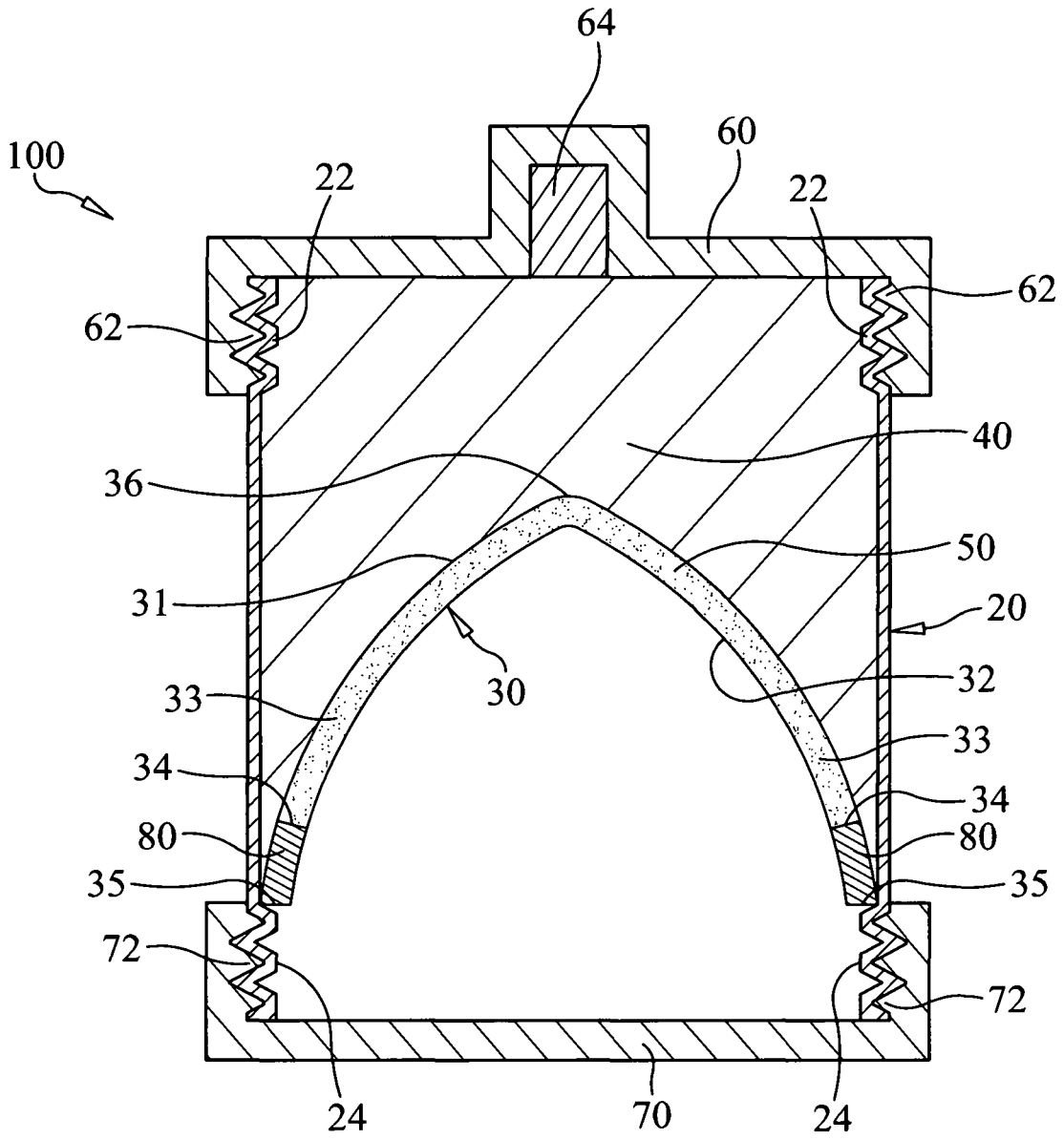
FIG. 2 is a schematic cross-sectional view of a shaped charge that includes a flexible seal in the liner's open-ended base in accordance with another exemplary embodiment of the present invention.

Another exemplary embodiment of the present invention is illustrated in FIG. 2 where a shaped charge 100 includes all of the above-described elements of shaped charge 10, and further includes a flexible seal 80 in open annular base 35. More specifically, after liner 30 has loose particulate material 50 deposited therein, flexible seal 80 is placed around open annular base 35 to form a seal with liner walls 31 and 32. Flexible seal (flexible material) 80 may be any flexible sealing material (e.g., putty, o-ring, etc.) having a (first) density that does not exceed, that is, at most equal to a (second) density of loose particulate material 50. Flexible seal 80 serves two purposes. First, flexible seal 80 seals open annular base 35 to prevent loose particulate material 50 from escaping. Second, the presence of flexible seal 80 allows the shock wave produced from the explosive detonating wave traveling down through liner 30 to gradually change pressure/density states from the particular liner material to the surrounding casing 20 and air. The shock will attenuate due to shock impedance similarities between the particulate and the flexible seal.

Figure 3:
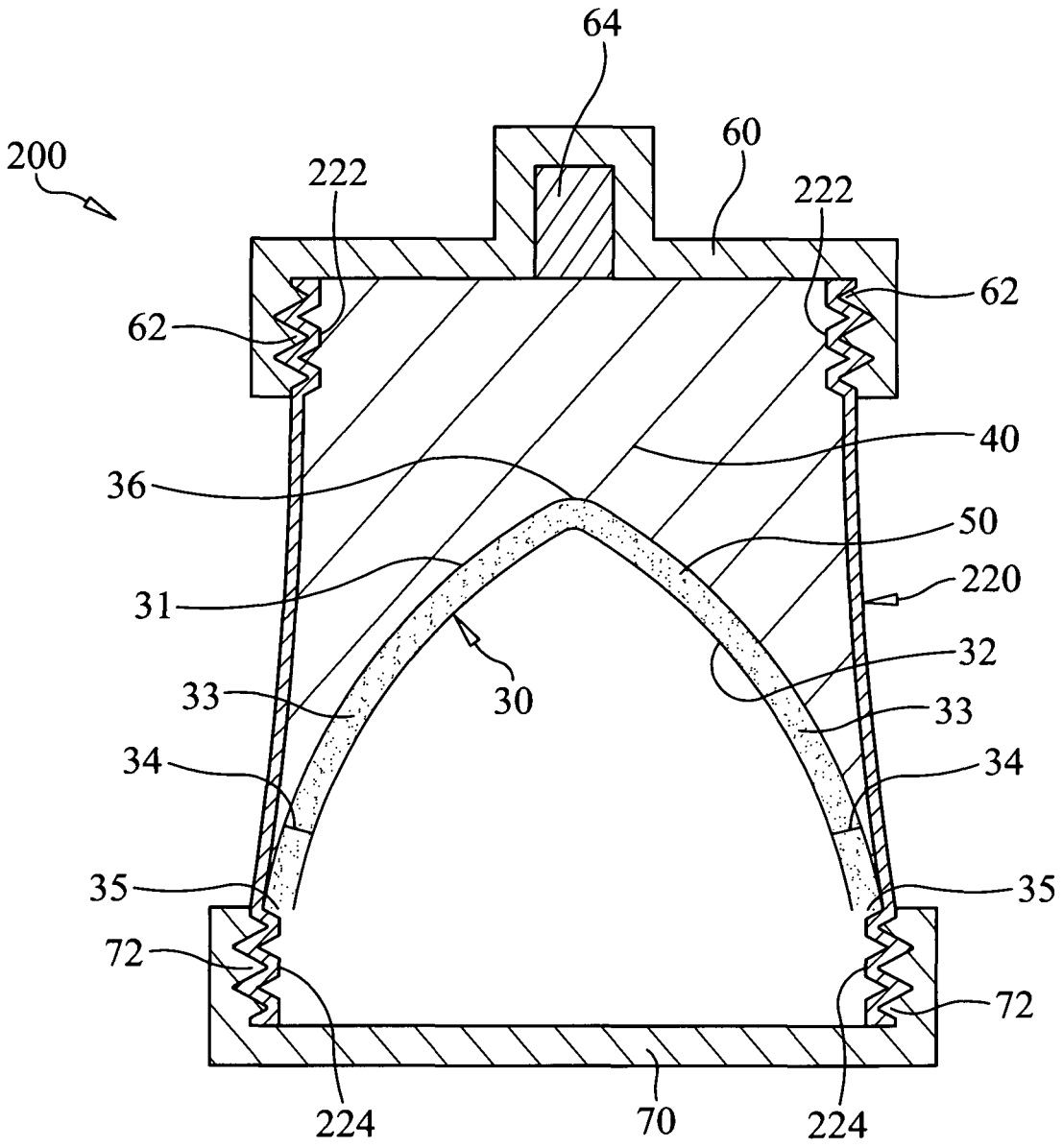
FIG. 3 is a schematic cross-sectional view of a shaped charge having a contoured outer casing wall in accordance with another exemplary embodiment of the present invention.

As mentioned previously, herein, the casing can be constructed with a taper or contour in order to reduce the shaped charge's overall explosive weight. An example of a contoured-wall casing type of shaped charge is illustrated in FIG. 3 and is referenced generally by numeral 200. Shaped charge 200 includes all of the above-described elements of shaped charge 10, but replaces casing 20 with a contoured casing 220 having threaded axial ends 222 and 224. In general, casing 220 is tapered in diameter as casing 220 traverses from threaded axial end 222 to threaded axial end 224.

In order to reduce overall explosive weight while maintaining a constant-diameter hole profile, it is desired to scale, linearly, down the explosive mass. The explosive material 40 directly adjacent to liner 30 for the original configuration has a mass ($m_0$) that is calculated as $$m_0 = \pi\rho\int_0^h (r_0^2 - r_L^2(y))dy \tag{6}$$

where ρ is density of explosive material 40, $r_0$ is the original radius for a non-tapered casing, and $r_L$ is the liner radius found by solving equation (1) as a function of height in the y-dimension as follows $$r_L(y) = \left(\frac{y-b}{a}\right)^{\frac{1}{2}} - c \tag{7}$$

Similarly, the explosive mass (ms) for the scaled configuration having a tapered-wall casing is calculated as $$m_s = \pi\rho\int_0^h (r_s^2(y) - r_L^2(y))dy = Sm_0 \tag{8}$$

where $r_s$ is the scaled wall radius and S is the scaling factor. Since equation (8) is just equation (6) multiplied by a constant, it therefore follows that $$\frac{dm_s}{dy} = S\frac{dm_0}{dy} \tag{9}$$

or $$r_s^2(y) - r_L^2(y) = S(r_0^2 - r_L^2(y)) \tag{9a}$$

Using equations (7) and (9a), the scaled wall radius is found to be $$r_s(y) = \left[Sr_0^2 + (1-S)\left(\left(\frac{y-b}{a}\right)^{\frac{1}{2}} - c\right)^2\right]^{\frac{1}{2}} \tag{10}$$

The advantages of the present invention are numerous. The shaped charge may produce a constant-diameter hole and may be assembled in the field using readily-available inert particulates for the shaped charge's liner.

Although the invention has been described relative to specific exemplary embodiments thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A shaped charge, comprising:

a casing;

a liner being disposed in said casing, said liner includes two spaced-apart and nested walls, each of said walls includes an identical ogive shape;

an explosive material being situated in the casing thereby filling a portion of said casing up to one of said walls;

a loose particulate material being disposed between said walls;

a blasting cap being coupled to a first axial end of said casing adjacent to said explosive material;

a sealing cap being coupled to a second axial end of said casing; and wherein said liner extends from a base having a width (w) to an apex at a height (h) measured from said base, and wherein said ogive shape follows a parabolic contour given by $$y = a(r+c)^2 + b$$

where y is a height of said liner at each radius r of said liner, and where $$a = \frac{w-h}{w^2}$$

$$b = h - \frac{w^2}{4(w-h)}$$

$$c = -\frac{w^2}{2(w-h)}.$$

2. The shaped charge as in claim 1, wherein said casing is a cylindrical shaped casing.

3. The shaped charge as in claim 1, wherein said casing tapers in diameter from said second axial end to said first axial end.

4. The shaped charge as in claim 1, wherein said liner is integrated with said casing.

5. The shaped charge as in claim 1, further comprising a flexible material being disposed between said walls and retaining said loose particulate material in said liner, wherein said flexible material includes a first density at most equal to a second density of said loose particulate material.

6. The shaped charge as in claim 1, wherein each slope of said walls is at maximum equal to 45°.

7. The shaped charge as in claim 1, wherein said loose particulate material comprises an inert material.

8. A shaped charge, comprising:

a casing including a first axial end and a second axial end, said casing includes a shaped and hollow liner disposed in and integrated with said casing, wherein said liner includes two spaced-apart and nested walls wherein each of said walls has an identical ogive shape, and wherein said liner includes an open-ended base integrated with said second axial end of said casing;

an explosive material filling a portion of said casing between one of said walls and said first axial end of said casing;

a loose particulate material being disposed between said walls;

a blasting cap being coupled to said first axial end of said casing adjacent to said explosive material;

a sealing cap being coupled to said second axial end of said casing; and wherein said liner extends from said open-ended base having a width (w) to an apex at a height (h) measured from said open-ended base base, and wherein said ogive shape follows a parabolic contour given by $$y = a(r+c)^2 + b$$

where y is a height of said liner at each radius r of said liner, and where $$a = \frac{w-h}{w^2}$$

$$b = h - \frac{w^2}{4(w-h)}$$

$$c = -\frac{w^2}{2(w-h)}.$$

9. The shaped charge as in claim 8, wherein said casing is a cylindrical shaped casing.

10. The shaped charge as in claim 8, wherein said casing tapers in diameter from said second axial end to said first axial end.

11. The shaped charge as in claim 8, further comprising a flexible material sealing said open-ended base, wherein said loose particulate material is retained in said liner, and wherein said flexible material includes a first density at most equal to a second density of said loose particulate material.

12. The shaped charge as in claim 8, wherein each slope of said walls is at maximum equal to 45°.

13. The shaped charge as in claim 8, wherein said loose particulate material comprises an inert material.

14. A shaped charge, comprising:

a casing;

a liner being disposed in said casing, wherein said liner includes two spaced-apart and nested walls, each of said walls includes an identical ogive shape, and wherein each slope of said walls is at maximum equal to 45°;

an explosive material filling a portion of said casing up to one of said walls;

a loose particulate material being disposed between said walls;

a flexible material being disposed between said walls and retaining said loose particulate material in said liner, wherein said flexible material includes a first density at most equal to a second density of said loose particulate material;

a blasting cap being coupled to a first axial end of said casing adjacent to said explosive material;

a sealing cap being coupled to a second axial end of said casing; and wherein said liner extends from a base having a width (w) to an apex at a height (h) measured from said base, and wherein said ogive shape follows a parabolic contour given by $$y=a(r+c)^2+b$$

where y is a height of said liner at each radius r of said liner, and where $$a = \frac{w-h}{w^2}$$

$$b = h - \frac{w^2}{4(w-h)}$$

$$c = -\frac{w^2}{2(w-h)}.$$

15. The shaped charge as in claim 14, wherein said casing is cylindrical.

16. The shaped charge as in claim 14, wherein said casing tapers in diameter from said second axial end to said first axial end.

17. The shaped charge as in claim 14, wherein said liner is integrated with said casing.

18. The shaped charge as in claim 14, wherein said loose particulate material comprises an inert material.

* * * * *